US007494364B2

(12) United States Patent
Sakamoto et al.

(10) Patent No.: US 7,494,364 B2
(45) Date of Patent: Feb. 24, 2009

(54) CONNECTOR

(75) Inventors: Kenji Sakamoto, Kanagawa (JP); Kiat Keen Chee, Singapore (SG); Chee Howe Wong, Singapore (SG)

(73) Assignee: J.S.T. Mfg. Co., Ltd., Osaka (JP)

( * ) Notice: Subject to any disclaimer, the term of this patent is extended or adjusted under 35 U.S.C. 154(b) by 154 days.

(21) Appl. No.: 11/605,938

(22) Filed: Nov. 29, 2006

(65) Prior Publication Data

US 2007/0128907 A1 Jun. 7, 2007

(30) Foreign Application Priority Data

Dec. 1, 2005 (SG) ..... 200507670-8

(51) Int. Cl.
*H01R 4/24* (2006.01)

(52) U.S. Cl. ..... 439/395; 439/400

(58) Field of Classification Search ..... 439/395, 439/397, 404, 425, 417, 419
See application file for complete search history.

(56) References Cited

U.S. PATENT DOCUMENTS 4,330,164 A * 5/1982 Pittman et al. ..... 439/293
5,000,698 A * 3/1991 Kuzuno et al. ..... 439/395
5,112,244 A * 5/1992 Kuzuno et al. ..... 439/395
6,190,203 B1 * 2/2001 Murakami et al. ..... 439/587
6,579,115 B2 * 6/2003 Mitsugi ..... 439/417

FOREIGN PATENT DOCUMENTS

JP 61-133584 6/1986
JP 2002-175845 6/2002

OTHER PUBLICATIONS

Patent Abstracts of Japan; Publication No. 2002-175845; Date of publication: Jun. 21, 2002 (2 pages).

* cited by examiner

*Primary Examiner*—Briggitte R Hammond
(74) *Attorney, Agent, or Firm*—Osha • Liang LLP

(57) ABSTRACT

The invention relates to a connector 1 comprising contact pins 3 and 3A having a contact part on a tip end thereof and a wire connection part on a rear end thereof, and a connector housing 4 having a receiving hole 5 for receiving therein the contact pins 3 and 3A and wires W. The connector 1 also includes a bridge type connection member 22 including a connection blade 23 which includes first and second contact parts 23*a* and 23*b* connected to each other via a junction piece 23*c*. The bridge type connection member 22 is pushed into the receiving hole 5 with the contact pins 3 and 3A and the wires W being received in the receiving hole 5, thereby connecting the connection parts of the contact pins 3 and 3A to core wires of the wires via the first and second contact parts 23*a* and 23*b*. This can provide a connector for easily connecting wires having various sizes and various types of contact pins without using a special tool.

23 Claims, 13 Drawing Sheets

FIG.6
Fig. 6A
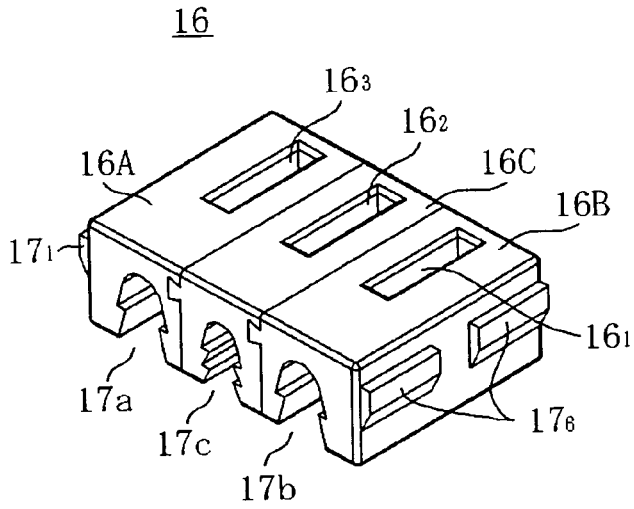
Fig. 6B
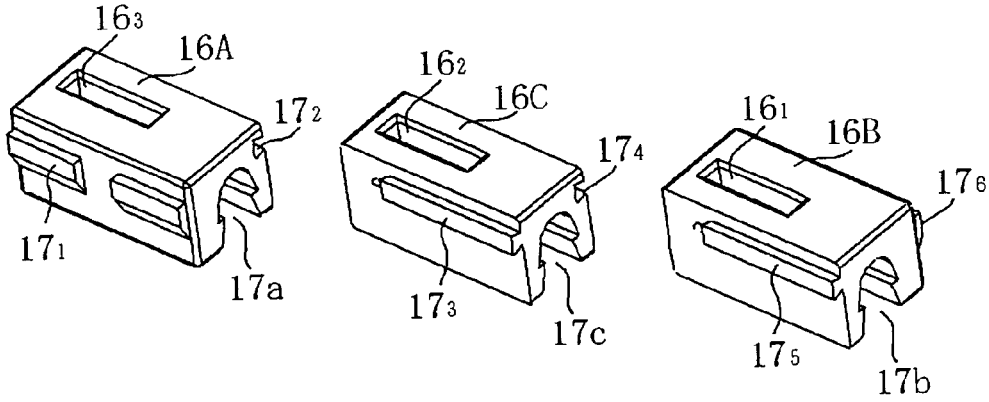

FIG.7
Fig. 7A
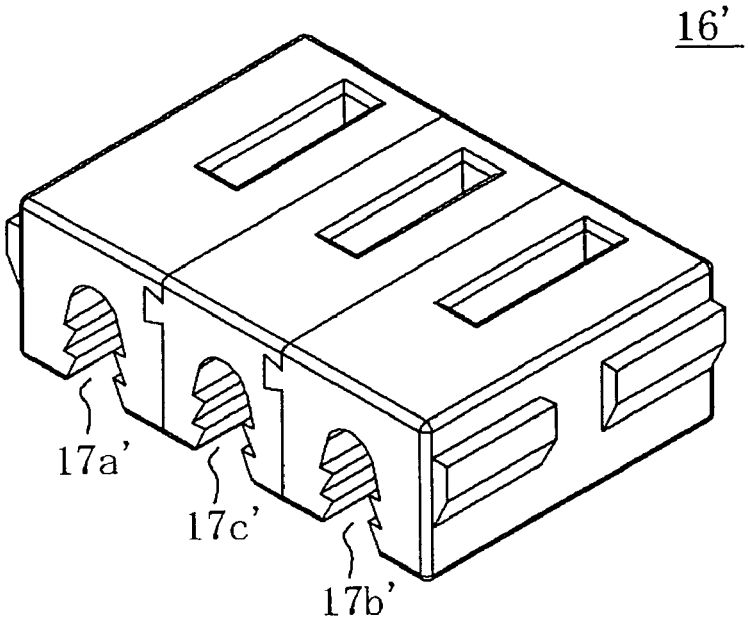
Fig. 7B
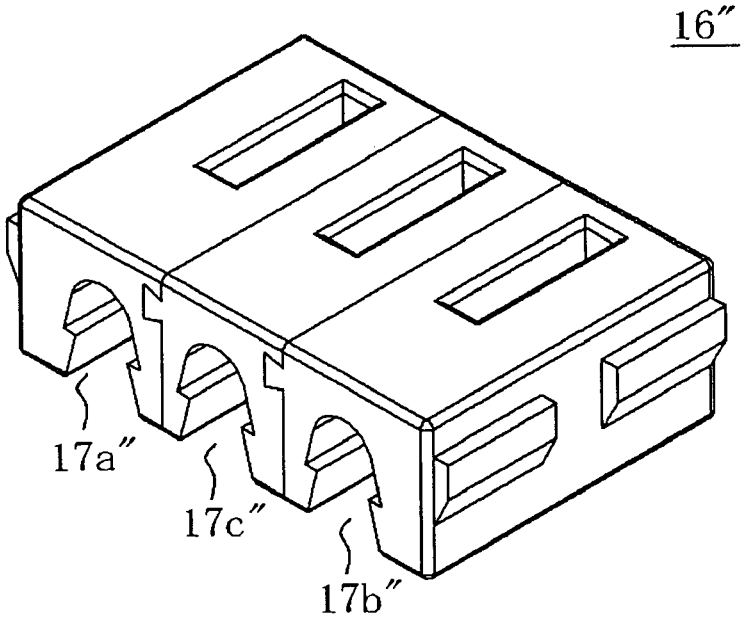

FIG.9
Fig. 9A
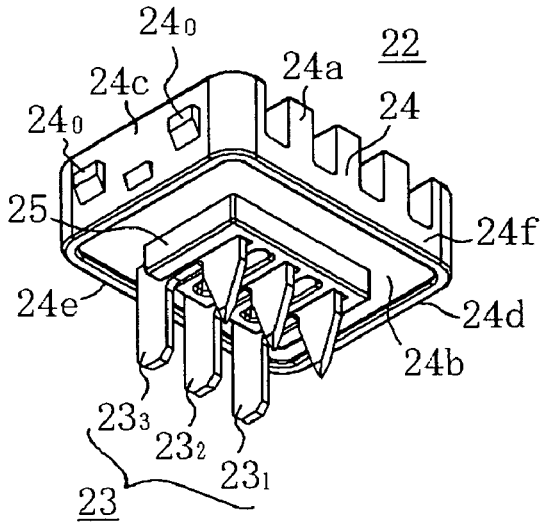
Fig. 9B
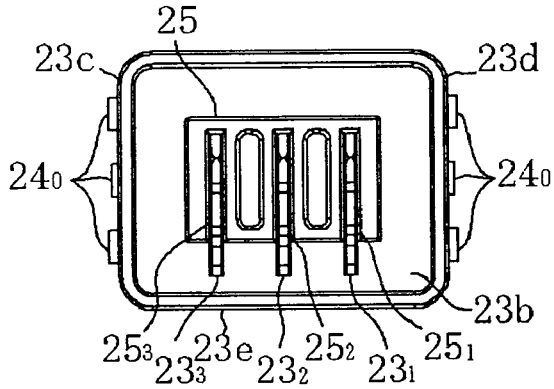
Fig. 9C
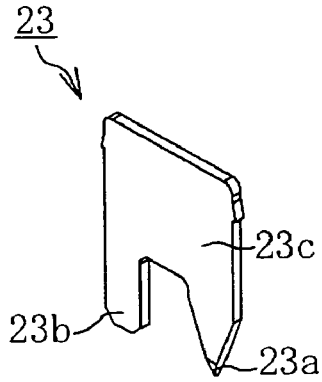

FIG.10
Fig. 10A
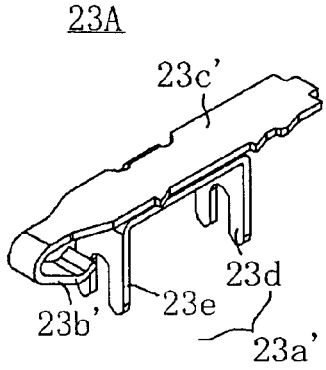
Fig. 10B
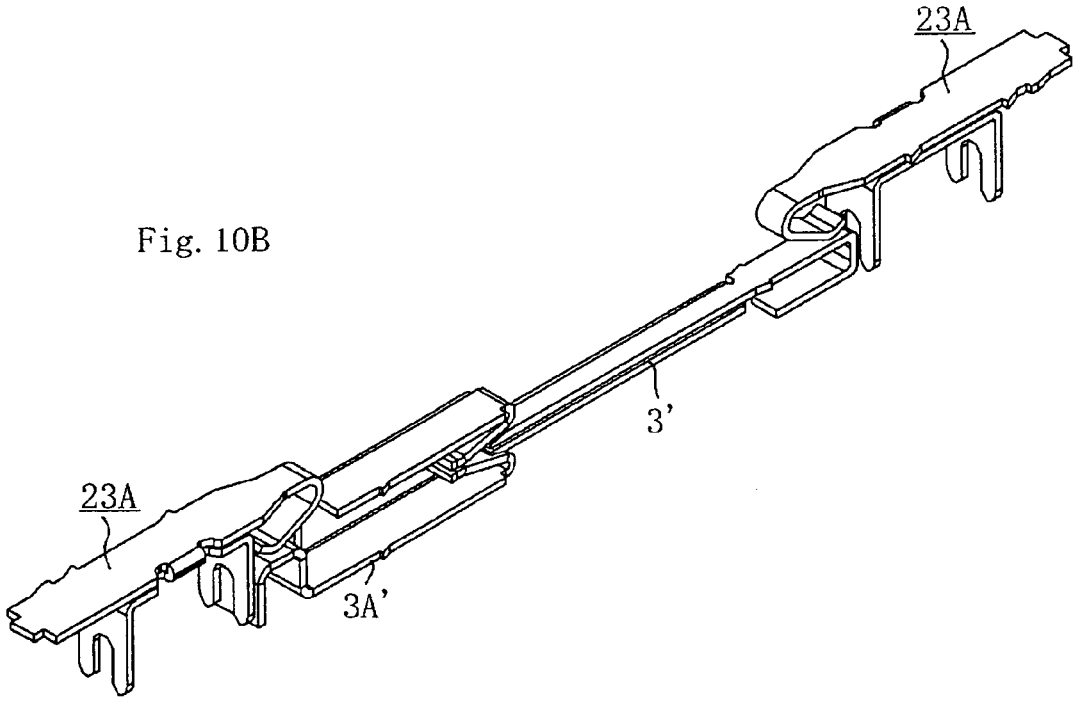

FIG.11
23B
Fig. 11A
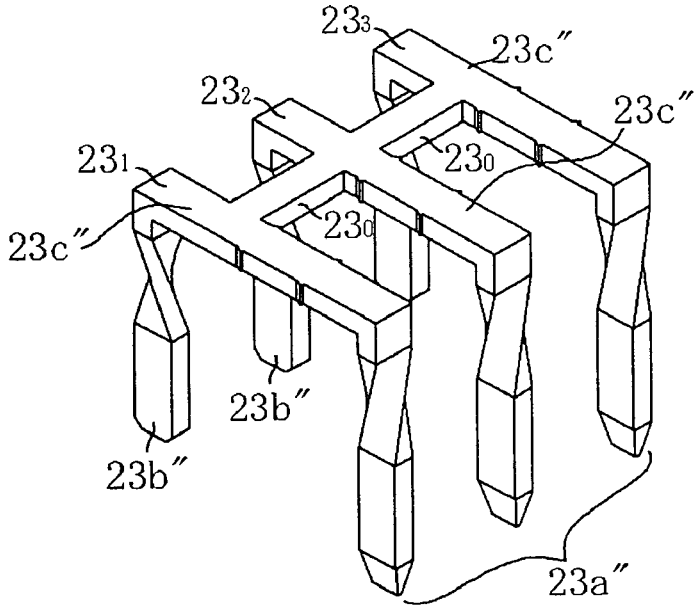
Fig. 11B
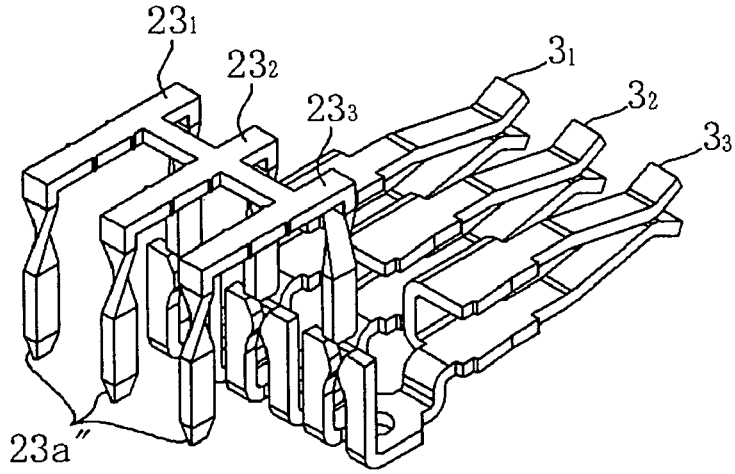

FIG.12
Fig. 12A
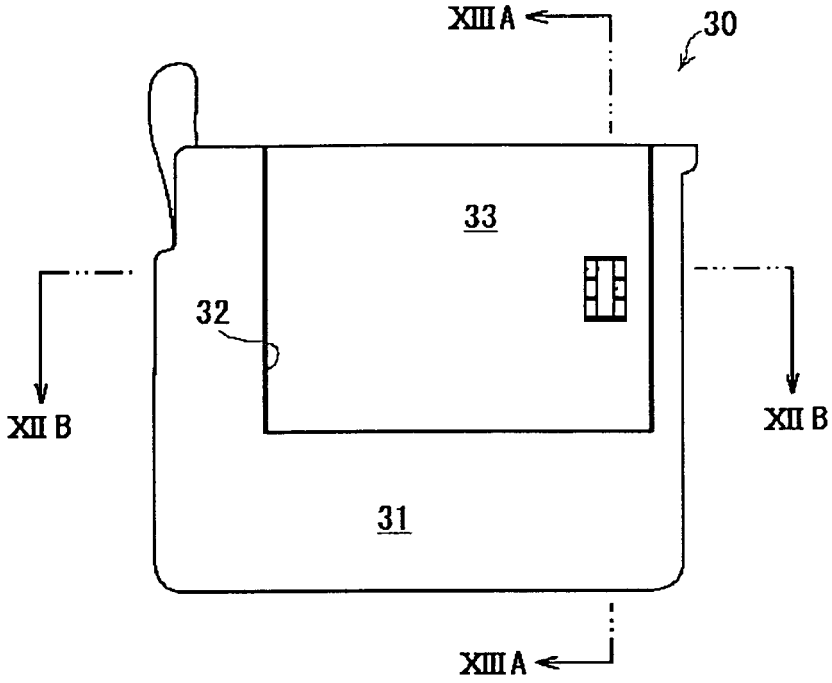
Fig. 12B
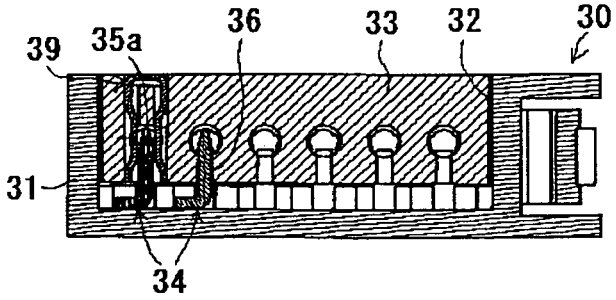
(prior art)

FIG.13
Fig. 13A
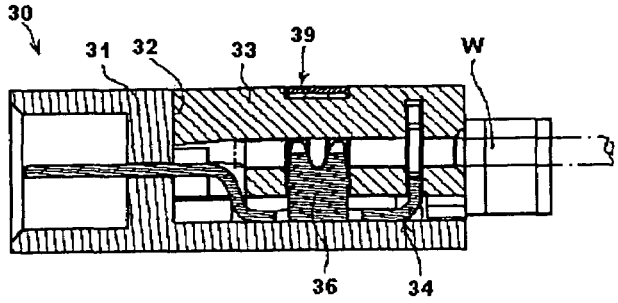
Fig. 13B
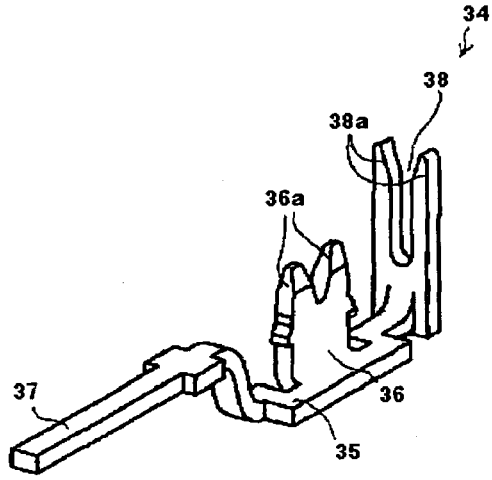
(prior art)

CONNECTOR

BACKGROUND OF THE INVENTION

The invention relates to electric connectors, and more specifically, to a connector for connecting contact pins and insulation coated wires to be fitted within a connector housing by pressing the contact pins against the insulation coated wires to break coating of the insulation coated wires so as to bring the contact pin into contact with a core wire without a special pressing tool, that is, to a connector equipped with the so-called piercing type contact pins.

Connectors equipped with the so-called piercing type contact pins have been developed and manufactured which are designed to connect contact pins and insulation coated wires to be fitted within a connector housing by pressing the insulation coated wires against the contact pins to break coating of the insulation coated wires so as to bring the contact pin into contact with the core wire without a specific pressing tool. Such a connector is disclosed in patent documents or the like, such as, for example, JP-A-2002-175845.

FIGS. 12 and 13 illustrate a connector disclosed in the above-mentioned patent document, in which FIG. 12A is a plain view of the connector, FIG. 12B is a cross-sectional view taken as a line XIIB-XIIB of FIG. 12A, FIG. 13A is a cross-sectional view taken as a line XIIIA-XIIIA of FIG. 12A, and FIG. 13B is a perspective view of a contact pin fitted to the connector.

The connector 30 as disclosed in the above patent document, as shown in FIG. 12, includes a plurality of contact pins 34, a connector housing 31 having a rectangular recess 32 on its upper wall, for receiving these contact pins 34 therein, and a cover housing 33 for holding a plurality of insulation coated wires, and which is inserted into the recess 32 of the housing. The contact pin 34 includes a base 35, a protruding tongue piece 36 protruded upward from the base 35, a contact part 37 provided at a front part of the base 35, and a wire locking part 38 standing vertically at a back part of the base 35 as shown in FIG. 13B. The tongue piece 36 has two separated sharp protrusions 36*a* formed on its tip end, which are designed to break the outer coating of the insulation coated wire (hereinafter referred to as a wire) so as to be brought into contact with a core wire. The wire locking part 38 has two locking pieces 38*a*, between which a wire W is sandwiched to be prevented from moving around as shown in FIG. 13A.

Connecting the contact pin 34 and the wire W involves inserting a plurality of wires into the cover housing 33 from circular holes disposed at the back part of the cover housing, holding the tip ends of the wires by a clip 39, and pushing the cover housing 33 into the recess 32. That is, pushing the cover housing causes each protrusion 36*a* of the protruding tongue piece 36 of the contact pin 34 to break the outer coating of the insulation coated wire W and enter into the core wire, thereby electrically connecting the contact pin 34 and the core wire of the wire. A connector with such a structure is also disclosed in JP-A-61-133584.

In the connectors as disclosed in the above prior art, by pushing the cover housing holding the plurality of wires into the recess of the connector housing, the protruding tongue pieces of the contact pins arranged in the recess of the connector housing are plunged into the insulation coated wires, causing the tongue piece to be brought into contact with the core wire of the wire. This allows the contact pins to be connected to the wire without using the specific pressing tool. In this connector, however, the wires are directly connected and fixed to the contact pins, and hence the wires and the contact pins are limited to the specific ones. Any selection and modification of these components cannot be carried out. For example, any one of wires with various sizes and any one of various types of connectors cannot be combined into and connected to each other, which disadvantageously results in a limited design for the connector. That is, the known connector employs only the contact pin that is appropriate for a certain size of the wire. For example, for a small-sized wire, only a contact pin having a wire connection part appropriate for the small-sized wire can be used. For a large-sized wire, only a contact pin having a wire connection part appropriate for the large-sized wire can be used. The combination of the contact pin and the size of the wire is limited, resulting in a small range of the connector design.

Further, in this connector, since one wire is connected to one contact pin, the relative number of wires and contact pins cannot be changed for connection. For example, by changing the numerical relationship between the wires and contact pins, a signal or electric power passing through one wire cannot be divided into a plurality of contact pins, or signals from a plurality of wires cannot be combined into one on the contact pin side.

Further, the known connector makes it difficult to have a structure with good resistance to water. That is, in this connector, the insulation coated wire is plunged into the protruding tongue piece of the contact pin by pushing the cover housing equipped with the wires into the recess of the connector housing. Since the wire is moved together with the cover housing, it is difficult to seal in a waterproof manner the cover housing and the wire, especially an outer periphery of the moving wire. Water may enter into between the recess of the connector housing and the cover housing, thus entering a connection part between the contact pin and the wire.

SUMMARY OF THE INVENTION

The present invention has been accomplished in view of the foregoing problems, and it is an object of the invention to provide a connector for being capable of combining and connecting wires having various sizes and various types of contact pins without using a special tool. It is another object of the invention to provide a connector with water resistance for being capable of combining and connecting wires having various sizes and various type of contact pins without using a specific tool.

To achieve the above-mentioned object, in a first aspect, the invention is directed to a connector comprising a contact pin having a contact part on a tip end thereof and a wire connection part on a rear end thereof, and a connector housing having a receiving hole for receiving therein the contact pin and a wire. The connector also includes a bridge type connection member including first and second contact parts connected to each other via a junction piece. The bridge type connection member is pushed into the receiving hole with the contact pin and the wire being received therein, thereby connecting the connection part of the contact pin to a core wire of the wire via the first and second contact parts.

In the first aspect, preferably, the first contact part of the bridge type connection member includes a contactor having a sharp fang shape or a U-shaped groove for breaking coating of an insulation coated wire to be brought into contact with the core wire, and the second contact part includes a contactor having a predetermined width for being brought into contact with the connection part of the contact pin.

Also, in the first aspect, the number of the first contact parts of the bridge type connection member may be the same as or different from that of the second contact parts thereof.

Preferably, in the first aspect, the contact pin is a female contact pin or a male contact pin, which is received in a female connector housing or a male connector housing.

In a second aspect, the invention is directed to a connector comprising a contact pin having a contact part on a tip end thereof and a wire connection part on a rear end thereof, and a connector housing having a receiving hole for receiving therein the contact pin and a wire, a wire fixing member being fitted into the receiving hole at a rear part of the housing. The connector also includes a bridge type connection member including first and second contact parts connected to each other via a junction piece. A first communication hole in communication with the receiving hole is formed on a wall surface of the connector housing. The first and second contact parts of the bridge type connection member are pushed into the first communication hole with the contact pin and the wire being received in the receiving hole, thereby connecting the connection part of the contact pin to a core wire of the wire via the first and second contact parts.

Also, preferably in the second aspect, the first contact part of the bridge type connection member includes a contactor having a sharp fang shape or a U-shaped groove for breaking coating of an insulation coated wire to be brought into contact with the core wire, and the second contact part includes a contactor having a predetermined width for being brought into contact with the connection part of the contact pin.

Further, in the second aspect, the number of the first contact parts of the bridge type connection member may be the same as or different from that of the second contact parts thereof.

Preferably, in the second aspect, the wire fixing member includes a holding member having a wire holding groove for holding the wire therein, the wire holding groove including a second communication hole in communication with the first communication hole. The wire fixing member also includes a fixing housing having a recessed hole for receiving therein the holding member, and a fixing hole for receiving therein the connection part of the contact pin, the fixing hole including a third communication hole in communication with the first communication hole. The wire fixing member is inserted into the receiving hole of the connector housing with the holding member being received in the recessed hole of the fixing housing. The first contact part of the bridge type connection member is pushed into and through the first and second communication holes, and the second contact part thereof is pushed into and through the first and third communication holes.

Also, preferably in the second aspect, the holding member is provided with the wire holding groove formed on one side of an insulating thick plate for being capable of receiving therein at least one wire, the wire holding groove having a groove width matching a size of the wire.

Further, preferably in the second aspect, the holding member includes of at least one insulating holding block, which includes a wire holding groove matching the size of the wire, and connection means for connection with another holding block.

In the second aspect, the contact pin is preferably a female contact pin or a male contact pin, which is received in a female connector housing or a male connector housing.

In a third aspect, the invention is directed to a connector comprising a contact pin having a contact part on a tip end thereof, and a wire connection part on a rear end, and a connector housing having a receiving hole for receiving therein the contact pin and a wire, a wire fixing member and a waterproof member being fitted into the receiving hole at a rear part of the housing. The connector also includes a bridge type connection member including first and second contact parts connected by a junction piece. A recessed hole into which the bridge type connection member is inserted is formed on a wall surface of the connector housing, the recessed hole including a first communication hole in communication with the receiving hole on a bottom of the housing. A seal member is fitted into the recessed hole, and the contact pin, the wire, the wire fixing member, and the waterproof member are fitted inside the receiving hole. The first and second contact parts of the bridge type connection member are pushed into the first communication hole, thereby connecting the connection part of the contact pin to a core wire of the wire via the first and second contact parts.

Preferably in the third aspect, the first contact part of the bridge type connection member includes a contactor having a sharp fang shape or a U-shaped groove for breaking coating of an insulation coated wire to be brought into contact with the core wire, and the second contact part includes a contactor having a predetermined width for being brought into contact with the connection part of the contact pin.

Also, in the third aspect, the number of the first contact parts of the bridge type connection member may be the same as or different from that of the second contact parts thereof.

Further, preferably in the third aspect, the wire fixing member comprises a holding member having a wire holding groove for holding the wire therein, the wire holding groove including a second communication hole in communication with the first communication hole. The wire fixing member also includes a fixing housing having a recessed hole for receiving therein the holding member, and a fixing hole for receiving therein the connection part of the contact pin, the fixing hole including a third communication hole in communication with the first communication hole. The wire fixing member is inserted into the receiving hole of the connector housing with the holding member being received in the recessed hole of the fixing housing. The first contact part of the bridge type connection member is pushed into and through the first and second communication holes, and the second contact part thereof is pushed into and through the first and third communication holes.

Also, in the third aspect, the holding member is preferably provided with the wire holding groove formed on one side of an insulating thick plate for being capable of receiving therein at least one wire, the wire holding groove having a groove width matching a size of the wire.

Preferably in the third aspect, the holding member includes at least one insulating holding block, the holding block including a wire holding groove matching the size of the wire, and connection means for connection with another holding block.

In the third aspect, the waterproof member is preferably a seal packing that is press-fitted into the receiving hole, the seal packing being made of a thick elastic body having an insertion hole matching the size of the wire.

In the third aspect, a seal cover having an insertion hole matching the size of the wire for covering the receiving hole is preferably fitted after attaching the seal packing.

Preferably in the third aspect, the contact pin is a female contact pin or a male contact pin, which is received in a female connector housing or a male connector housing.

In the third aspect, one of the male and female connectors with a connector seal member fitted thereto is preferably connected to the other via the seal member.

Further, in the third aspect, the connector seal member is preferably an elastic cylindrical seal member which is fitted to an outer periphery of a protrusion protruding from a back part of a plug-in of the female connector forward, and receiving therein the female contact pin.

Preferably in the third aspect, the connector seal member consist of the elastic cylindrical seal body and a rigid cylindrical seal body, and the elastic cylindrical body has a convex bump part on an outer periphery thereof in a direction orthogonal to a cylindrical opening, the convex bump being fitted to the protrusion in series.

The invention with the above-mentioned structure has the following advantages. That is, in the connector according to the first aspect of the invention, the connection part of the contact pin and the core wire of the wire are connected to each other by means of the bridge type connection member including the first and second contact parts connected to each other via a junction piece. This enables easy manufacturing of various connectors consisting of any combinations of various types of contact pins and wires of various sizes. In other words, when the wire connection part of the contact pin and the wire are connected to each other using the bridge type connection member, the wire is not directly fixed to the wire connection part of the contact pin, unlike in the case of the prior art. Thus, any wire and contact pin can be selected from the wires of various sizes and various types of contact pins, thus enabling the connection between the wire and contact pin selected as one combination, thereby easily manufacturing a connector with a broad range of applications.

Further, in the first aspect, the first contact part of the bridge type connection member may consist of a contactor having a sharp fang shape or a U-shaped groove for breaking coating of an insulation coated wire to be brought into contact with the core wire, and the second contact part may consist of a contactor having a predetermined width for being brought into contact with the connection part of the contact pin. This enables easy connection between the insulation coated wire and the contact pin without using a special tool.

In the bridge connection member, the number of the first contact parts may be the same as or different from that of the second contact parts. This allows splitting or merging of signals and electric power from the wires connected to the first contact parts. Assuming that one first contact part and two second contact parts are used, a signal or electric power from the one wire connected to the first contact part is split into two components at the second contact parts via the junction part. In a reverse case, that is, when using two first contact parts and one second contact part, signals or electric power from the wires connected to the first contact parts are merged into one component at the second contact part via the junction piece.

It should be noted that the connector according to the first aspect can manufacture any one of the male and female connectors.

In the connector according to the second aspect of the invention, the connection part of the contact pin and the core wire of the wire are connected to each other by means of the bridge type connection member including the first and second contact parts connected to each other via a junction piece. This enables easy manufacturing of various connectors consisting of any combinations of various types of contact pins and wires of various sizes. Since the first and second contact parts of the bridge type connection member are pushed into the first communication hole, each contact part is guided by the first communication hole, thereby providing a precise connection between the wire and the contact pin.

In the second aspect, the first contact part of the bridge type connection member may be a contactor having a sharp fang shape or a U-shaped groove for breaking coating of an insulation coated wire to be brought into contact with the core wire, and the second contact part may be a contactor having a predetermined width for being brought into contact with the connection part of the contact pin. This enables easy connection between the insulation coated wire and the contact pin without using a special tool.

In the second aspect, in the bridge type connection member, the number of the first contact parts of the bridge type connection member may be the same as or different from that of the second contact parts thereof. This allows splitting or merging of signals and electric power from the wires connected to the first contact parts.

Further, in the second aspect, the wire fixing member may comprise the holding member having the second communication hole and the wire holding groove, and the fixing housing for receiving therein the holding member, the fixing housing including the third communication hole. The wire fixing member may be inserted into the receiving hole of the connector housing with the holding member being received in the fixing housing, resulting in precise alignment and fixing of the wires and the contact pins. Additionally, the first and second contact parts may be guided by the first and second communication holes, and by the first and third communication holes, respectively, resulting in precise connection between the wire and the contact pin.

In the second aspect, the holding member may be provided with the wire holding groove for being capable of receiving therein at least one wire on one side of an insulating thick plate, the wire holding groove having a groove width matching the size of the wire. Thus, a plurality of wires having the same or different sizes can be fitted to the one thick plate, facilitating the attachment of wires.

In the second aspect, the holding member may consist of at least one insulating holding block, the holding block including a wire holding groove matching the size of the wire, and connection means for connection with another holding block. This facilitates selection and connection of the holding blocks, thereby forming the holding member applicable for wires of various sizes.

The connector according to the second aspect may be manufactured as either a male or female connector.

In the connector according to the third aspect of the invention, the connection part of the contact pin and the core wire of the wire are connected to each other by means of the bridge type connection member including the first and second contact parts connected to each other via a junction piece. This enables easy manufacturing of various connectors consisting of any combinations of various types of contact pins and wires of various sizes. Further, the seal member is fitted or attached to the recessed hole formed on the wall of the connector housing, for receiving the bridge type connection member fitted therein. This can render the attachment part of the connection member waterproof. The attachment of the seal member to the rear side of the receiving hole can prevent entry of water from the attachment part of the wire fixing member.

In the third aspect, the first contact part of the bridge type connection member may be a contactor having a sharp fang shape or a U-shaped groove for breaking coating of an insulation coated wire to be brought into contact with the core wire, and the second contact part may be a contactor having a predetermined width for being brought into contact with the connection part of the contact pin. This enables easy connection between the insulation coated wire and the contact pin without using a special tool.

In the third aspect, in the bridge type connection member, the number of the first contact parts of the bridge type connection member may be the same as or different from that of the second contact parts thereof, and these contact parts may be connected to one another via a junction piece and a short piece. This allows splitting or merging of signals and electric power from the wires connected to the first contact parts.

Further, in the third aspect, the wire fixing member may comprise the holding member having the second communication hole and the wire holding groove, and the fixing housing for receiving therein the holding member, the fixing housing including the third communication hole. The wire fixing member may be inserted into the receiving hole of the connector housing with the holding member being received in the fixing housing, resulting in precise alignment and fixing of the wires and the contact pins. Additionally, the first and second contact parts may be guided by the first and second communication holes, and by the first and third communication holes, respectively, resulting in precise connection of the wire and the contact pin.

In the third aspect, the holding member may be provided with the wire holding groove for being capable of receiving therein at least one wire on one side of an insulating thick plate, the wire holding groove having a groove width matching the size of the wire. Thus, a plurality of wires having the same or different sizes can be fitted to the one thick plate, facilitating the attachment of wires.

In the third aspect, the holding member may consist of at least one insulating holding block, the holding block including a wire holding groove matching the size of the wire, and connection means for connection with another holding block. The use of this holding member facilitates selection and connection of the holding blocks, thereby forming the holding member applicable for wires of various sizes.

Further, in the third aspect, the waterproof member may be a seal packing, on a rear part of which a seal cover is fitted for protecting the seal packing. This seal packing achieves good waterproof effect. In addition, the attachment of the seal cover to the seal packing can prevent the seal packing from being disconnected, while relieving tension of a wire even when the wire is curved by the seal cover, thereby decreasing the tension of the wire transmitted to the seal packing. This may not deform the insertion hole of the seal packing due to the bent wire, making it difficult to create a clearance between the insertion hole of the seal packing and the wire.

The connector according to the third aspect may be manufactured as either a male or female connector.

In the third aspect, one of the male and female connectors may have a connector seal member fitted thereto, and is connected to the other via the seal member, thereby preventing the entry of water from the connection part between both connectors.

In the third aspect, the connector seal member may be a cylindrical seal body, thereby facilitating the attachment to the female connector, while preventing water from entering the connection part between both connectors.

In the third aspect, the connector seal member may consist of elastic cylindrical seal body and rigid cylindrical seal body. These cylindrical seal bodies may be fitted to the protrusion in series, resulting in a structure with water resistance. One cylindrical seal body having the convex bump part is disposed facing the back part of the protrusion, and the other cylindrical seal body is disposed facing the front part, while preventing disconnection of these cylindrical seal bodies.

BRIEF DESCRIPTION OF THE DRAWINGS

A construction in accordance with the invention will now be described with reference to the accompanying drawing, in which:

FIG. 6A is a perspective view of a holding member consisting of holding blocks connected to one another;

FIG. 6B is a perspective view of a state in which the holding blocks are separated from one another;

FIGS. 7A and 7B are perspective views showing a modified example of a different combination of holding blocks constituting the holding member shown in FIG. 6;

FIG. 9A is a perspective view of a bridge type connection member fitted to the female connector;

FIG. 9B is a diagram of a bottom surface of the bridge type connection member of FIG. 9A;

FIG. 9C is a perspective view of a connection blade;

FIGS. 10A and 10B are perspective views of a modified example of a connection blade of the bridge type connection member;

FIGS. 11A and 11B are perspective views of a modified example of a connection blade of the bridge type connection member;

FIG. 12A is a plain view of a connector in the prior art;

FIG. 12B is a sectional view taken along a line XIIB-XIIB of FIG. 12A;

FIG. 13A is a cross-sectional view of the connector in the prior art taken along a line XIIA-XIIIA of FIG. 12A; and FIG. 13B is a perspective view of a contact pin to be fitted to the connector.

DESCRIPTION OF THE PREFERRED EMBODIMENT

Reference will now be made to preferred embodiments of the invention, which are illustrated in the accompanying drawings. It should be noted that the exemplary embodiments described below are for illustrative purpose of embodying the technical idea of the invention, and should not be construed to limit the invention to the connector disclosed. Thus, those skilled in the art will appreciate that other embodiments might be equally applicable without departing from the sprit and scope of the appended claims.

First Embodiment

Figure 1:
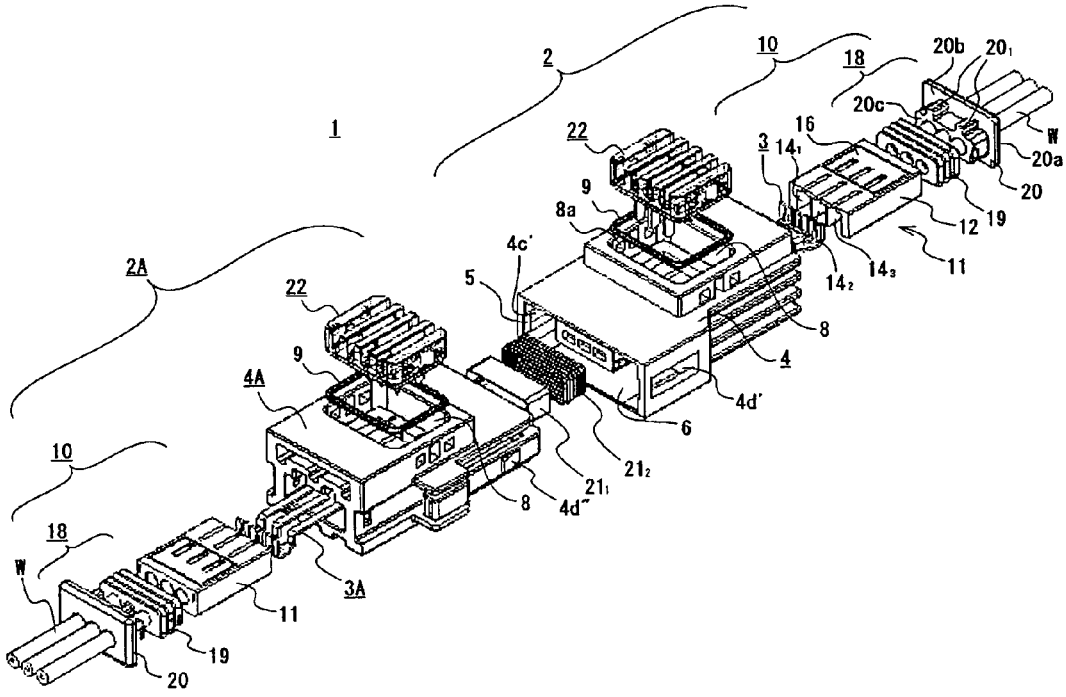
FIG. 1 is an exploded perspective view of a male connector and a female connector, each separately divided, according to one preferred embodiment of the invention.

A connector 1 according to a first embodiment includes a female connector 2 and a male connector 2A as shown in FIG. 1, which are connected together, causing wires W to be electrically connected to the connector via contact pins in the connectors. These connectors have a structure with water resistance. Now, the female and male connectors will be described in more detail in this order.

The female connector 2 includes a plurality of female contact pins 3 (hereinafter simply referred to as a contact pin) having on its tip end a contact part to come in contact with a contact pin 3A of the male connector 2A, and on its rear end a connection part to come in contact with a wire. The female connector 2 also includes a connector housing 4 with a recessed hole 5 formed on its upper wall for receiving the plurality of contact pins 3. Further, the female connector 2 includes a wire fixing member 11 for aligning and fixing a plurality of wires W, a waterproof member 18 for covering a receiving hole 5 of the connector housing 4 to prevent entry of water, and a bridge type connection member 22 having a pair of first and second contact parts for connecting the wires W and a plurality of contact pins 3. Pushing the bridge type connection member 22 into the recessed hole 8 of the connector housing 4 causes the first contact part of the bridge type connection member 22 to be brought into contact with core wires of the wires W, while causing the second contact part to come in contact with the contact pins 3 whereby the contact pins 3 and the wires W are electrically connected to one another.

Figure 2:
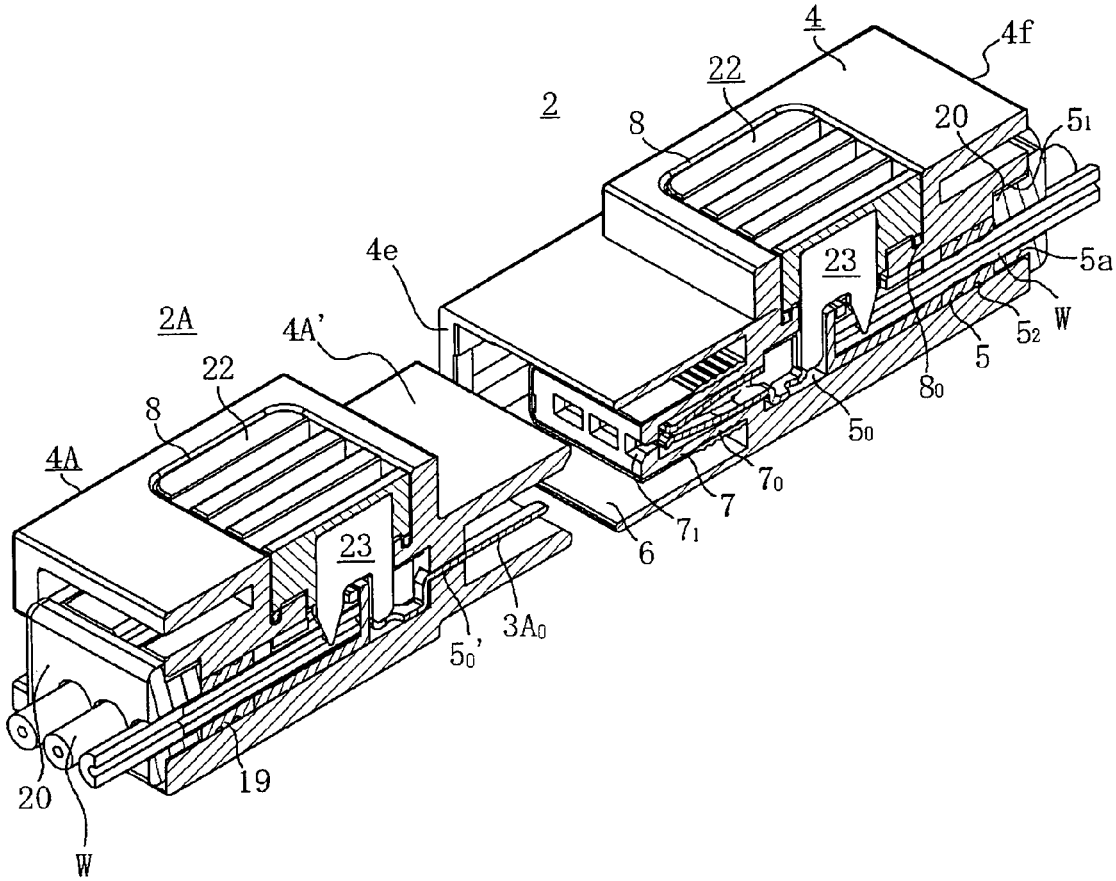
FIG. 2 is a perspective view of an assembly of the male and female connectors of FIG. 1, including a cross section taken along the center line of the assembly in the longitudinal direction.
Figure 3:
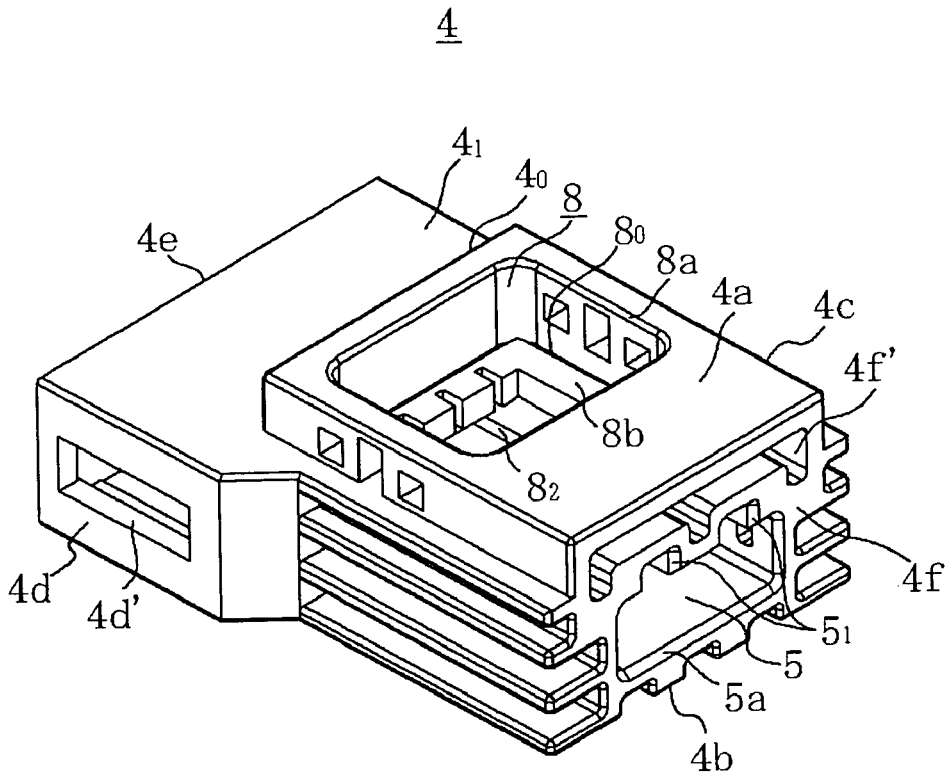
FIG. 3 is a perspective view of a female connector housing of FIG. 1.

The connector housing 4, as shown in FIG. 3, consists of a flat rectangular parallelepiped body having predetermined height, width, and length, that is, a rectangular parallelepiped block which is enclosed with upper, lower, left, right, front, and back walls 4*a* to 4*f*. The connector housing is made of insulating synthetic resin. The connector housing 4 has on the back wall 4*f* a receiving hole 5 having a space with enough size to receive therein the wire fixing member 11 and the waterproof member 18. The receiving hole 5 has an opening part 5*a* that has a rectangular shape matching a shape of the wire fixing member 11 or the like. A back part 50 of the receiving hole 5 reaches a midpoint of the front part of the housing 4 (see FIG. 2). The receiving hole 5 has different shapes at the opening part and the back part. That is, the opening part 5*a* has on an upper-side inner wall two grooves $\mathbf{5}_1$ for receiving a seal cover 20 inserted, which is a part of the waterproof member 18.

A plug-in 6 having enough size to receive a protrusion of the male connector 2A inserted therein is formed on the front wall 4*e* of the connector housing 4. As shown in FIG. 2, the plug-in 6 consists of a cavity having a predetermined depth, at the back part of which a relatively long protrusion 7 is formed in the center thereof for protruding towards an opening part of the plug-in 6. The protrusion 7 has on its inner side a plurality of pin receiving holes $\mathbf{7}_0$ for receiving a plurality of contact pins 3, for example, three pin receiving holes. These pin receiving holes $\mathbf{7}_0$ are in communication with the receiving hole 5, and the tip end of the protrusion 7 forms a small hole $\mathbf{7}_1$ having enough size to cause the male contact pin 3A to be inserted therein. The protrusion 7 is equipped with a pair of cylindrical seal members $\mathbf{21}_1$ and $\mathbf{21}_2$ arranged in series around the outer periphery thereof, as shown in FIG. 1. Each of the cylindrical seal members $\mathbf{21}_1$ and $\mathbf{21}_2$ has an opening into which the protrusion 7 is press-fitted with its outer periphery abutted against the cylindrical seal member, and an elastic body made of, for example, a rubber material, having a predetermined width. The cylindrical seal member $\mathbf{21}_2$ has an uneven surface on its outer periphery. The connector housing 4 has on front parts of both side walls 4*c* and 4*d*, engagement holes 4*c*' and 4*d*' for engagement with locking protrusions of the male connector 2A.

The upper wall 4*a* of the connector housing 4 has a thin, namely, low front part $\mathbf{4}_1$, and a thick back part that is formed so as to increase the thickness from the front part $\mathbf{4}_1$ via a step part $\mathbf{4}_0$. The thick back part has on its flat surface, the recessed hole 8 into which the bridge type connection member 22 is fitted. The recessed hole 8 has a rectangular opening 8*a* matching an appearance of the bridge type connection member 22, and is a recessed hole having a predetermined depth. The recessed hole 8 is formed above an area where the wires W and connection parts of the contact pins 3 are disposed, as described later. The recessed hole 8 also includes a recessed groove $\mathbf{8}_0$ into which an O-ring 9 is inserted, on its inner periphery of the bottom wall 8*b*. Further, on the bottom wall 8*b*, a plurality of elongated grooves $\mathbf{8}_1$ to $\mathbf{8}_3$ are disposed at predetermined intervals, which are in communication with the receiving hole 5. It should be noted that in FIG. 3, only the elongated groove $\mathbf{8}_2$ is shown, and other elongated grooves $\mathbf{8}_1$ and $\mathbf{8}_3$ adjacent to the elongated groove $\mathbf{8}_2$ are not shown in the figure. Each of the elongated grooves $\mathbf{8}_1$ to $\mathbf{8}_3$ has enough size to receive the first and second contact parts of the bridge type connection member 22 when they are inserted therein, as described later. The distance between the elongated grooves $\mathbf{8}_1$ to $\mathbf{8}_3$ is the same as that between the wires Ws or the contact pins 3 arranged in parallel to one another in the connector housing 4. The O-ring 9 is fixed into the recessed groove $_{80}$, and the bridge type connection member 22 is pushed into the recessed hole 8, thereby sealing the bridge type connection member 22 with the O-ring 9, thus preventing entry of water. Note that reference numeral 4*f*' indicates a mold hole for eliminating distortion in plastic molding.

Figure 4:
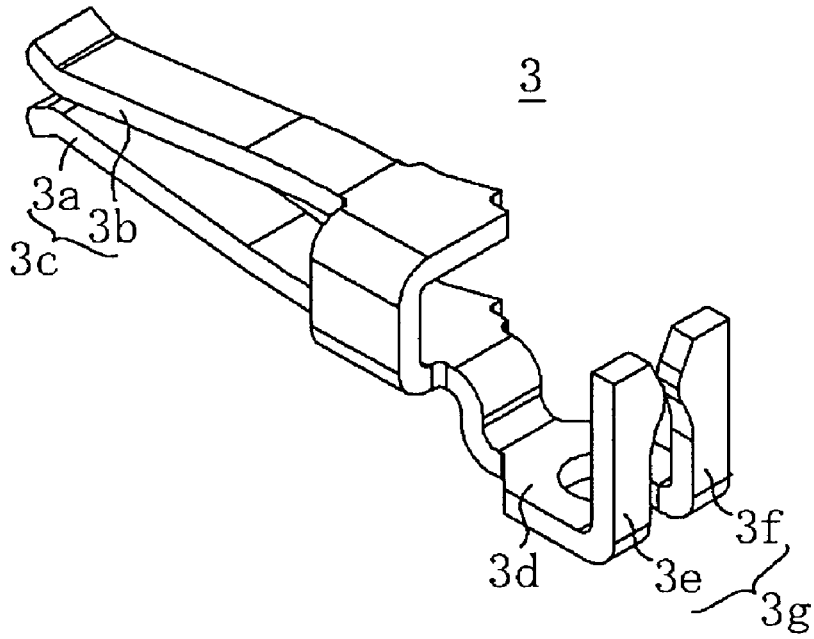
FIG. 4 is a perspective view of a female contact pin fitted to the female connector of FIG. 1.

The contact pin 3, as shown in FIG. 4, includes a contact part 3*c* consisting of a pair of holding pieces 3*a* and 3*b* into between which the contact pin 3A of the male connector 2A positioned at one forward end is inserted. The contact pin 3 is extended and enlarged from the center part thererof in a longitudinal direction, and has at the enlarged part 3*d* on its rear end, a holding contact 3*g* consisting of a pair of holding pieces 3*e* and 3*f* opposed to each other for holding a second contact part of the bridge type connection member 22. The contact part 3*c* and the holding contact 3*g* are integrally formed by bending a metal plate with good electrical conductivity. The pair of opposed holding pieces 3*e* and 3*f* of the holding contact 3*g* stands vertically from the enlarged part 3*d*, and the pieces are enlarged and extended adjacently to each other such that the tip ends of the pieces can hold the second contact part of the bridge type connection member 22 between adjacent side walls thereof.

A wire fixing part 10, as shown in FIG. 1, includes the wire fixing member 11 for fixing the plurality of wires W, while supporting the other ends of the contact pins 3, and the waterproof member 18 which is press-fitted into the receiving hole 5 of the connector housing 4 to prevent the entry of water.

Figure 5:
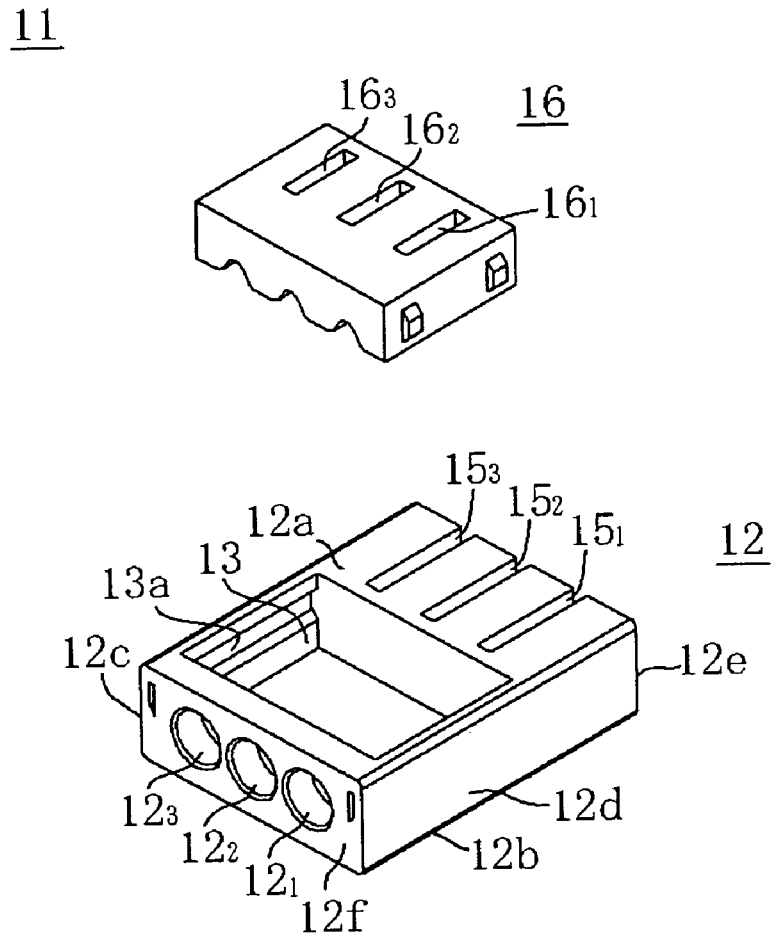
FIG. 5 is an exploded perspective view of a wire fixing member.

The wire fixing member 11 includes a fixing housing 12 consisting of a rectangular parallelepiped block having upper, lower, left, right, front and back walls 12*a* to 12*f*, and a holding member 16 for aligning and fixing the plurality of wires W, as shown in FIGS. 5 and 6. These components are made of insulating synthetic resin.

The fixing housing 12 has on its upper wall 12*a* a recessed hole 13 having a predetermined depth into which the holding member 16 is inserted. On the back wall 12*f*, insertion holes $\mathbf{12}_1$ to $\mathbf{12}_3$ are provided which the plurality of wires W, for example, three wires W, are inserted into. These insertion holes $\mathbf{12}_1$ to $\mathbf{12}_3$ are in communication with the recessed hole 13. On the front wall 12*e*, a receiving hole is provided which consists of reverse-recessed grooves $\mathbf{14}_1$ to $\mathbf{14}_3$ separated by three partitions and having enough size to receive the pair of holding pieces 3*e* and 3*f* of the three contact pins 3, for example (see FIG. 1). These reverse-recessed grooves $\mathbf{14}_1$ to $\mathbf{14}_3$ have on its upper part, three slits $\mathbf{15}_1$ to $\mathbf{15}_3$ that are arranged at predetermined intervals in the longitudinal direction in communication with the upper wall 12*a* of the fixing housing 12. These slits $\mathbf{15}_1$ to $\mathbf{15}_3$ are provided such that they are positioned on an extended line between the holding pieces 3*a* and 3*b* of each of the female contact pins $\mathbf{3}_1$ to $\mathbf{3}_3$ when the female contact pins $\mathbf{3}_1$ to $\mathbf{3}_3$ are received in the recessed grooves $\mathbf{14}_1$ to $\mathbf{14}_3$ , respectively. The recessed hole 13 of the fixing housing 12 has locking parts 13*a* for locking the holding member 16 formed on its inner wall.

The holding member 16 consists of a plurality of, for example, three holding blocks 16A to 16C, as shown in FIG. 6, which can be combined into one unit and fitted into the recessed hole 13 of the fixing housing 12. Each holding block is made of insulating synthetic resin. The three holding blocks 16A to 16C are composed of three kinds of blocks, namely, first and second holding blocks 16A and 16B for engaging with the engaging parts 13*a* of the recessed hole 13 of the fixing housing 12, and a third holding block 16C positioned between and connected to the first and second holding blocks 16A and 16B.

The first to third holding blocks 16A to 16C have substantially the same shape but have the respective different connection means for connecting the blocks to one another. More specifically, the first to third holding blocks 16A to 16C have reverse U-shaped grooves 17*a* to 17*c* formed on the bottom wall and matching the size of the respective wires W. The holding blocks also include elongated grooves $\mathbf{16}_1$ to $\mathbf{16}_3$ formed on the upper wall thereof. Each of reverse U-shaped grooves 17*a* to 17*c* is extended in the longitudinal direction of each holding block for holding the wires W inside, and has locking protrusions for preventing disconnection of the wires on a side wall near an opening on the bottom. The elongated grooves $\mathbf{16}_1$ to $\mathbf{16}_3$ are in communication with the respective reverse U-shaped grooves 17*a* to 17*c*, and are provided adjacently to the slits $\mathbf{15}_1$ to $\mathbf{15}_3$ of the fixing housing 12.

The connection means for the first to third holding blocks 16A to 16C will be described below. The first holding block 16A has a locking protrusion $\mathbf{17}_1$ formed on one side wall parallel to the longitudinal direction for engaging with an engagement part 13*a*, and a linear engagement groove $\mathbf{17}_2$ extended from the rear end to the nearby front end and formed on the other side wall opposed to the one side, for engaging with a liner protrusion $\mathbf{17}_3$ of the third holding block 16C. The second holding block 16B has a linear protrusion $\mathbf{17}_5$ on one side wall extended from the rear end to the nearby front end for engaging with an engagement groove $\mathbf{17}_4$ of the third holding block 16C, and a locking protrusion $\mathbf{17}_6$ on the other side wall for engaging with the engagement part 13*a*. The third holding block 16C has a locking protrusion $\mathbf{17}_3$ formed on one side wall in the longitudinal direction for being inserted into the engagement groove $\mathbf{17}_2$ of the first holding block 16A, and an engagement groove $\mathbf{17}_4$ formed on the other side wall for engaging with the linear protrusion 175 of the second holding block 16B. In FIG. 6, the number of wires W is three, and thus the first to third holding blocks 16A to 16C are respectively provided for the wires. When four or more wires W intend to be connected, a plurality of the third holding blocks 16C may be prepared for and combined into one unit, and the third holding blocks 16C located on both sides of the unit may be connected to the first and second holding blocks, respectively. Accordingly, any other number of holding blocks can be added easily according to the number of the wires W.

The three kinds of holding blocks 16A to 16C are connected to one another and combined into the holding member 17 in such a manner that the reverse U-shaped grooves 17*a* to 17*c* are formed to match the size of the wires W. FIG. 7 illustrates examples of combination of a plurality of holding blocks. A holding member 16' shown in FIG. 7A is formed to have reverse U-shaped grooves 17*a*' to 17*c*" that are narrower than those in FIG. 6, and thus is useful for a small-sized wire. Further, the holding member 16" shown in FIG. 7B is formed to have reverse U-shaped grooves 17*a*" to 17*c*" that are wider than those as shown in FIG. 6, and thus is useful for a large-sized wire. In the reverse U-shaped grooves 17*a*' to 17*c*' of the holding block to be used for the small wires W, such as that shown in FIG. 7A, the wires W are so small that they intend to disconnect from the holding blocks. For this reason, the holding block has a locking protrusion having two steps formed on its side walls for preventing the disconnection of the wire.

When wires W having different sizes are connected, the size of each reverse U-shaped groove may be selected according to the size of each wire, and then holding blocks with the respective appropriate grooves may be combined. Although in the above embodiment, holding member 16 is respectively composed of the separated first to third holding blocks 16A to 16C, the holding member may be made of only one block, that is, one sheet of plate (for example, see FIG. 5).

The waterproof member 18 includes the seal packing 19 for being press-fitted into the receiving hole 5 of the connector housing 4 to prevent the entry of water from the outer periphery of the wire W, and a seal cover 20 for covering the opening 5*a* of the receiving hole 5.

Figure 8:
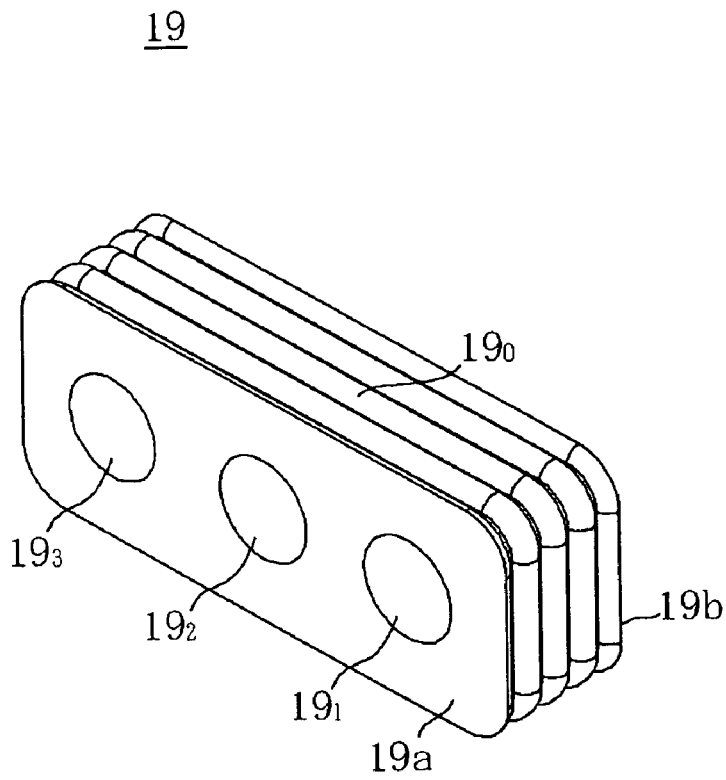
FIG. 8 is a perspective view of a seal packing.

The seal packing 19, as shown in FIGS. 1, 2, and 8, has an appearance having predetermined size and thickness to be press-fitted into the receiving hole 5 of the connector housing 4, and is made of an elastic material, for example, rubber. The seal packing 19 has insertion holes $\mathbf{19}_1$ to $\mathbf{19}_3$ into which three wires W are inserted from the back wall 19*b* to the front wall 19*a*. On the outer periphery of the seal packing 19, a plurality of uneven parts $\mathbf{19}_0$ are preferably formed in a direction orthogonal to the insertion direction of the wire W. Provision of the uneven parts $\mathbf{19}_0$ causes the uneven parts to strongly abut against the inner wall surface of the receiving hole 5 when it is press-fitted into the receiving hole 5, thereby resulting in good sealing effect.

The seal cover 20 is larger than the opening 5*a* of the receiving hole 5 of the connector housing 4, as shown in FIGS. 1 and 2, and is a plate-shaped member made of, for example, resin material, for closing the opening 5*a*. The seal cover 20 has insertion holes into which three wires are inserted from a back wall surface 20*a* toward a front wall surface 20*b*. On the front wall surface 20*b*, is formed a protrusion 20*c* having enough size to be inserted into the receiving hole 5 of the connector housing 4, and enough length to be protruded and press-fitted into the receiving hole 5. And, on the upper surface of the protrusion 20*c*, there are provided two protruding parts $\mathbf{20}_1$, which are fitted into grooves 51 of the receiving hole 5. It should be noted that although the seal cover 20 is described herein as a part of the waterproof member 18, the seal cover 20 serves to prevent the disconnection of the seal packing 19 for sealing the receiving hole 5, and to prevent tension of the wires W from being transmitted to the seal packing 19, and thus the seal cover 20 does not have necessarily any waterproof effect. That is, for example, if the wire W were excessively bent respective to the female connector 2 with the seal cover 20 not being fitted, the tension of the bent wire would be transmitted directly to the insertion holes $\mathbf{19}_1$ to $\mathbf{19}_3$ of the seal packing 19, thereby deforming the insertion holes $\mathbf{19}_1$ to $\mathbf{19}_3$, resulting in decreased waterproof effect. However, in the embodiments, the seal cover 20 can relieve the tension of the wire W at the insertion hole thereof before the tension is transmitted to the seal packing 19. This prevents the wires W inserted into the insertion holes $\mathbf{19}_1$ to $\mathbf{19}_3$ of the seal packing 19 from being bent largely, making it difficult for the insertion holes $\mathbf{19}_1$ to $\mathbf{19}_3$ to be deformed, thus maintaining high level of waterproof effect for a long time. In addition, since the seal cover 20 is provided to press and hold the seal packing 19, the disconnection of the seal packing 19 can be prevented.

As shown in FIG. 9, the bridge type connection member 22 includes a connection blade 23 with good electrical conductivity, the blade including first and second contact parts 23*a* and 23*b* on both ends, and a connection piece 23*c* for connecting both contact parts, and an insulating support plate 24 for fixing the connection blades 23 standing at predetermined intervals in parallel to each other via the connection pieces 23*c*. The bridge type connection member 22 has a plurality of, for example, three pieces of connection blades $\mathbf{23}_1$ to $\mathbf{23}_3$ fitted thereto, which have the same shape. Taking one of the connection blades as an example with reference to FIG. 9C, the first contact part 23*a* of the connection blade 23 consists of a contactor having a sharp fang-shaped tip end, and is configured to easily reach and come in contact with a core wire inside the wire when penetrating the outer coating of the insulation coated wire W, which is coated with insulator. The second contact part 23*b* is a plate-shaped contactor having a predetermined thickness to be inserted into between the holding pieces 3*e* and 3*f* of the contact pin 3. When it is inserted into between the holding pieces 3*e* and 3*f*, the second contact part 23*b* is held in a contact state. The first and second contact parts 23*a* and 23*b* are connected to each other via the junction piece 23*c* having a relatively large width. These parts and the piece may be integrally formed by stamping a metal plate having good electrical conductivity.

The support plate 24 is made of a rectangular insulating plate having a predetermined thickness so as to match the shape of the recessed hole 8 of the connector housing 4. The rectangular support plate 24 has front, back, long-side, and short-side walls 24*a* to 24*f*. On a pair of the short-side walls 24*c* and 24*d*, a plurality of locking protrusions $\mathbf{24}_0$ are provided for engaging with the locking hole 8*a* on the inner peripheral wall surface of the recessed hole 8. In the center of the back wall surface 24*b* is formed a low rectangular base 25, which has a plurality of, for example, three recessed grooves $\mathbf{25}_1$ to $\mathbf{25}_3$ extending in the lateral direction. Note that these recessed grooves $\mathbf{25}_1$ to $\mathbf{25}_3$ are extended from a point near one side to another point near the other side, and stopped at the point near the other side, thereby serving to prevent the disconnection. The width of each of the recessed grooves $\mathbf{25}_1$ to $\mathbf{25}_3$ is long enough to allow for insertion of the connection blade 23, so that the connection blades $\mathbf{23}_1$ to $\mathbf{23}_3$ are respectively press-fitted into and fixed to the recessed grooves $\mathbf{25}_1$ to $\mathbf{25}_3$.

The first contact part 23*a* of the connection blade 23 consists of a contactor having a sharp fang-shaped tip end, which is not limited thereto. For example, the first contact part 23*a* may include a contactor having a reverse U-shaped tip end instead of the fang-shaped end. FIG. 10A is a perspective view of a connection blade with the reverse U-shaped first contact part, and FIG. 10B is a perspective view showing a state of connection of the connection blade with the male and female contact pins.

The connection blade 23A includes a strip piece 23*c*' having predetermined width and length. The blade 23A also includes a first contact part 23*a*' consisting of a pair of contactors 23*d* and 23*e* which are positioned in the vicinity of both ends of the strip piece 23*c*' in the longitudinal direction with a predetermined distance spaced from the strip piece 23*c*' downward, and which have the respective reverse U-shaped grooves. Further, the connection blade 23A includes a second contact part 23*b*' formed by bending one front end of the strip piece 23*c*'. These parts are formed by bending a metal plate with good electrical conductivity. The reverse U-shaped grooves of the contactors 23*d* and 23*e* are formed so as to have a width that is a little smaller than a diameter of the core wire of the wire W, and are configured to be press-fitted against the outer periphery of the core wire when the wires W are pushed into the grooves. The edges of the contactors 23*d* and 23*e* opposed to each other and forming the reverse U-shaped groove are formed so as to have a blade shape, whereby the contactors can break the outer coating of the wires W when the wires W are pushed into the grooves. The second contact part 23*b*' has elasticity with its tip end bent into a U shape, and adapted to be in elastic contact with the contact pin 3'. One or more connection blades 23A are fitted to the support plate 24 to form the bridge type connection member 22. The connection blade 23A is brought into contact with the core wire by breaking the outer coating of the insulation coated wire by the reverse U-shaped groove, as well as with the female and male contact pins 3' and 3A', as shown in FIG. 10B.

Although the above-mentioned bridge type connection member 22 has the support plate 24 equipped with a plurality of connection blades 23 and 23A individually separated, the connection member is not limited thereto. For example, a plurality of connection blades may be combined into one unit. FIG. 11A is a perspective view showing an example of a combined connection blade consisting of a combination of a plurality of connection blades; and FIG. 11B is a perspective view showing a connection state of the combined connection blade and the female contact pin.

The combined connection blade 23B consists of a plurality of, for example, three connection blades $\mathbf{23}_1$ to $\mathbf{23}_3$ arranged in parallel to one another at predetermined intervals therebetween. Each connection blade includes a first contact part 23*a*" whose tip end is sharp, a second contact part 23*b*" made of an elongate plate, and a junction part 23*c*" for connecting these contact parts as shown in FIG. 11A. Each junction pieces 23*c*", 23*c*", and 23*c*" of the connection blades $\mathbf{23}_1$ to $\mathbf{23}_3$ are connected together via short pieces $\mathbf{23}_0$ and $\mathbf{23}_0$, and fitted to the insulating support plate (not shown in the figure), to form the bridge type connection member. The combined connection blade 23B is connected to the three female contact pins 31 to 33 (see FIG. 11B). Note that for the purpose of simplicity, the junction piece 23*c*" and the short piece $\mathbf{23}_0$ are described herein as separate components. The short piece $\mathbf{23}_0$ is a part of the junction piece 23*c*". That is, the short piece $\mathbf{23}_0$ is formed integrally with the junction piece from one metal electrical conductor.

In the above-mentioned combined connection blade 23B, the number of the first contact part 23*a*" is the same as that of the second contact part 23*b*", but may be different from it. For example, one first contact part 23*a*" and two second contact parts 23*b*" are prepared to be combined by a branched junction piece to form a combined connection blade. The use of the combined connection blade splits a signal or electric power from the wire connected to the first contact part 23*a*" into two components via the branched junction piece at the second contact part 23*b*". In a reverse case, that is, when using a combined connection blade consists of a combination of two first contact parts 23*a*" and one second contact part 23*b*" connected via the branched junction piece, signals or electric power from the wires W connected to the first contact parts 23*a*" are merged into one component at the second contact part 23*b*" via the junction piece.

An assembly method of the female connector 2 includes the following steps. First, three contact pins $\mathbf{3}_1$ to $\mathbf{3}_3$ are inserted into and received in a pin receiving hole $\mathbf{7}_0$ of a protrusion 7 from the receiving hole 5 of the connector housing 4. Then, the three holding blocks 16A to 16C and a fixing housing 12 are selected which match the three contact pins $\mathbf{3}_1$ to $\mathbf{3}_3$ received in the connector housing 4, and are appropriate for the respective sizes of three insulation coated wires W of interest. The holding blocks 16A to 16C selected are connected to one another to form the holding member 16. Three wires W are inserted into the respective insertion holes of the seal packing 19 and the seal cover 20, and further into three insertion holes $\mathbf{12}_1$ to $\mathbf{12}_3$ of the fixing housing 12. The holding member 16 is fitted into the recessed hole 13 of the fixing housing 12 with the wires being inserted, thereby holding and fixing the wires in the holding blocks 16A to 16C to assemble the wire fixing member 11.

Among the wire fixing part 10 consisting of the wire fixing member 11 and the waterproof member 18, first the wire fixing member 11 is inserted from the receiving hole 5 located at the back part of the connector housing 4 into the housing, and then the seal packing 19 is also pushed into the receiving hole. The pushing of the seal packing causes the seal packing 19 to be brought into intimate contact with the inner wall surface of the receiving hole 5 because of its elasticity, while causing the seal packing to press the peripheral part of the wire W to thereby form a seal for preventing the entry of water. After fixing the seal packing 19 to the inner surface of the receiving hole 5, the seal cover 20 is press-fitted into the opening 5*a* of the receiving hole to close the opening 5*a*. Thus, the seal packing 19 and seal cover 20 are fitted into the receiving hole 5, thereby preventing water from entering from the wire fixing part 10.

Thereafter, the O-ring 9 is fitted into the recessed hole 8 of the connector housing 4, into which the bridge type connection member 22 is pushed, causing the contact pin 3 to be brought into contact with the insulation coated wire W. That is, the first contact parts 23*a* of the connection blades $\mathbf{23}_1$ to $\mathbf{23}_3$ of the bridge type connection member 22 are pushed into and through the elongated grooves (first connection holes) $\mathbf{8}_1$ to $\mathbf{8}_3$, and elongated grooves (second connection holes) $\mathbf{16}_1$ to $\mathbf{16}_3$ of the holding member 16 to break the coating of the insulation coated wires W by the fang-shaped contactors therefof, which are brought into contact with the core wires. The second contact parts 23*b* of the connection blades $\mathbf{23}_1$ to $\mathbf{23}_3$ of the bridge type connection member 22 are pushed into and through the elongated grooves (first connection holes) 81 to 83, and the slits (third connection holes) $\mathbf{15}_1$ to $\mathbf{15}_3$ of the fixing housing 12 to be inserted into between the pair of holding pieces 3*e* and 3*f* of the contact pin 3, so that the second contact parts 23*b* are held by and brought into contact with the holding pieces. Pushing the bridge type connection member 22 into the recessed hole 8 causes the support plate 24 of the member to push against the O-ring 9 to form a seal. Around the protrusion 7 within the plug-in 6, the cylindrical seal member 212 and the cylindrical seal member 211 are fitted in this order. This completes the assembly of the female connector 2.

Now, the male connector 2A will be described mainly with reference to FIGS. 1 and 2. The male connector 2A and the female connector 2 are the same in the structure of the wire holding part 16 and the bridge type connection member 22, but are different in only the structure of the contact pin and the connector housing 4A equipped with the contact pin. Thus, the common parts between both connectors will not be explained below, and only the different parts between them will be explained hereinafter in detail.

A male contact pin 3A includes a contact part $\mathbf{3A}_0$ made of one pin and located on the front part thereof. The tip end of the contact part $\mathbf{3A}_0$ is sharpened so as to be inserted into between the holding pieces 3*a* and 3*b* of the female contact pin 3. The other structure, such as the rear end, of the male contact pin 3A has the same as that of the female contact pin 3, and thus the explanation therefore will be omitted.

The male connector housing 4A has on its front side a protrusion 4A' which is inserted into the plug-in 6 of the female connector 2. On the back part of a receiving hole in the male connector housing 4A, an elongated groove $\mathbf{5}_0$' into which the tip end of the male contact pin 3A is inserted is formed. The assembly of the male connector 2A includes substantially the same processes as that of the assembly of the female connector 2.

The female connector 2 is connected with the male connector 2A by inserting the protrusion 4A' of the male connector into the plug-in 6 of the female connector 2. This insertion causes the cylindrical seal member $\mathbf{21}_2$ to be press-fitted strongly against the inner peripheral wall surface of the front part of the protrusion 4A'. During the insertion, the locking protrusions 4*c*" and 4*d*" provided on both sides of the protrusion 4A' of the male connector housing 4A are engaged with the engagement holes 4*c*' and 4*d*' of the female connector housing 4, and thus prevented from being disconnected. (In FIG. 1, the locking protrusion 4*c*" is not shown.)

Note that although the connector 1 according to the above-mentioned embodiments may have various water proof structures as explained above, the connector 1 may be any other appropriate one without the seal member. Further, although the seal member for connection of the female connector 2 and the male connector 2A is fitted to the female connector, the seal member may be changed into another shape so as to be fitted into the male connector.

What is claimed is:

1. A connector comprising:

a contact pin having a contact part on a tip end thereof and a wire connection part on a rear end thereof;

a connector housing having a receiving hole for receiving therein the contact pin and a wire, a wire fixing member being filled into the receiving hole at a rear part of the connector housing; and a bridge connection member including first and second contact parts connected to each other via a junction piece, wherein the bridge connection member is pushed into the receiving hole with the contact pin and the wire being received in the receiving hole, thereby connecting the contact part of the contact pin to a core wire of the wire via the first and second contact parts.

2. The connector according to claim 1, wherein the first contact part of the bridge connection member includes a contactor having a sharp fang shape or a U-shaped groove for breaking coating of an insulation coated wire to be brought into contact with the core wire, and the second contact part includes a contactor having a predetermined width for being brought into contact with the contact part of the contact pin.

3. The connector according to claim 1, wherein the number of the first contact parts of the bridge connection member is the same as or different from that of the second contact parts thereof.

4. The connector according to claim 1, wherein the contact pin is a female contact pin or a male contact pin, which is received in a female connector housing or a male connector housing.

5. A connector comprising:

a contact pin having a contact part on a tip end thereof and a wire connection part on a rear end thereof;

a connector housing having a receiving hole for receiving therein the contact pin and a wire, a wire fixing member being fined into the receiving hole at a rear part of the connector housing; and a bridge connection member including first and second contact parts connected to each other via a junction piece, wherein a first communication hole in communication with the receiving hole is formed on a wall surface of the connector housing, and wherein the first and second contact parts of the bridge connection member are pushed into the first communication hole with the contact pin and the wire being received in the receiving hole, thereby connecting the contact part of the contact pin to a core wire of the wire via the first and second contact parts.

6. The connector according to claim 5, wherein the first contact part of the bridge connection member includes a contactor having a sharp fang shape or a U-shaped groove for breaking coating of an insulation coated wire to be brought into contact with the core wire, and the second contact part includes a contactor having a predetermined width for being brought into contact with the contact part of the contact pin.

7. The connector according to claim 5, wherein the number of the first contact pads of the bridge connection member is the same as or different from that of the second contact parts thereof.

8. The connector according to claim 5, the wire fixing member comprising:

a holding member having a wire holding groove for holding the wire therein, the wire holding groove including a second communication hole in communication with the first communication hole; and a fixing housing having a recessed hole for receiving therein the holding member, and a fixing hole for receiving therein the contact part of the contact pin, the fixing hole including a third communication hole in communication with the first communication hole, wherein the wire fixing member is inserted into the receiving hole of the connector housing with the holding member being received in the recessed hole of the fixing housing, and wherein the first contact part of the bridge connection member is pushed into and through the first and second communication holes, and the second contact part thereof is pushed into and through the first and third communication holes.

9. The connector according to claim 8, wherein the holding member is provided with the wire holding groove formed on one side of an insulating thick plate for being capable of receiving therein at least one wire, the wire holding groove having a groove width matching a size of the wire.

10. The connector according to claim 8, wherein the holding member includes at least one insulating holding block, the holding block including the wire holding groove matching the size of the wire, and connection means for connection with another holding block.

11. The connector according to claim 5, wherein the contact pin is a female contact pin or a male contact pin, which is received in a female connector housing or a male connector housing.

12. A connector comprising:

a contact pin having a contact part on a tip end thereof, and a wire connection part on a rear end;

a connector housing having a receiving hole for receiving therein the contact pin and a wire, a wire fixing member and a waterproof member being fitted into the receiving hole at a rear part of the connector housing; and a bridge connection member including first and second contact parts connected by a junction piece, wherein a recessed hole into which the bridge connection member is inserted is formed on a wall surface of the connector housing, the recessed hole including a first communication hole in communication with the receiving hole on a bottom of the connector housing, wherein a seal member is fined into the recessed hole, and the contact pin, the wire, the wire fixing member, and the waterproof member are fitted inside the receiving hole, and wherein the first and second contact parts of the bridge connection member are pushed into the first communication hole, thereby connecting the contact part of the contact pin to a core wire of the wire via the first and second contact parts.

13. The connector according to claim 12, wherein the first contact part of the bridge connection member includes a contactor having a sharp fang shape or a U-shaped groove for breaking coating of an insulation coated wire to be brought into contact with the core wire, and the second contact part includes a contactor having a predetermined width for being brought into contact with the contact part of the contact pin.

14. The connector according to claim 12, wherein the number of the first contact parts of the bridge connection member is the same as or different from that of the second contact parts thereof.

15. The connector according to claim 12, the wire fixing member comprising:

a holding member having a wire holding groove for holding the wire therein, the wire holding groove including a second communication hole in communication with the first communication hole; and a fixing housing having a recessed hole for receiving therein the holding member, and a fixing hole for receiving therein the contact part of the contact pin, the fixing hole including a third communication hole in communication with the first communication hole, wherein the wire fixing member is inserted into the receiving hole of the connector housing with the holding member being received in the recessed hole of the fixing housing, and wherein the first contact part of the bridge connection member is pushed into and through the first and second communication holes, and the second contact part thereof is pushed into and through the first and third communication holes.

16. The connector according to claim 15, wherein the holding member is provided with the wire holding groove formed on one side of an insulating thick plate for being capable of receiving therein at least one wire, the wire holding groove having a groove width matching a size of the wire.

17. The connector according to claim 15, wherein the holding member includes at least one insulating holding block, the holding block including the wire holding groove matching the size of the wire, and connection means for connection with another holding block.

18. The connector according to claim 12, wherein the waterproof member is a seal packing that is press-fitted into the receiving hole, the seal packing being made of a thick elastic body having an insertion hole matching the size of the wire.

19. The connector according to claim 18, wherein after attaching the seal packing, a seal cover having an insertion hole matching the size of the wire for covering the receiving hole is fitted.

20. The connector according to claim 12, wherein the contact pin is a female contact pin or a male contact pin, which is received in a female connector housing or a male connector housing.

21. The connector according to claim 20, wherein one of the male and female connectors with a connector seal member fitted thereto is connected to the other via the connector seal member.

22. The connector according to claim 21, wherein the connector seal member is an elastic cylindrical seal member which is fitted to an outer periphery of a protrusion protruding from a back part of a plug-in of the female connector forward, the protrusion receiving therein the female contact pin.

23. The connector according to claim 22, wherein the connector seal member consist of the elastic cylindrical seal body and a rigid cylindrical seal body, and the elastic cylindrical seal bodies has a convex bump part formed on an outer periphery thereof in a direction orthogonal to a cylindrical opening, the convex bump part being fined to the protrusion in series.

* * * * *

UNITED STATES PATENT AND TRADEMARK OFFICE

CERTIFICATE OF CORRECTION

PATENT NO. : 7,494,364 B2
APPLICATION NO. : 11/605938
DATED : February 24, 2009
INVENTOR(S) : Kenji Sakamoto et al.

It is certified that error appears in the above-identified patent and that said Letters Patent is hereby corrected as shown below:

On the Cover Page:

On the Cover Page, item (73) Assignee, add the name of the second assignee -- MEA Technologies Pte. Ltd.--.

In the Claims:

In Claim 2, column 17, line 21, the word "pads" should be --parts--.

Signed and Sealed this

Twenty-third Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,494,364 B2
APPLICATION NO. : 11/605938
DATED : February 24, 2009
INVENTOR(S) : Kenji Sakamoto et al.

It is certified that error appears in the above-identified patent and that said Letters Patent is hereby corrected as shown below:

On the Cover Page:

On the Cover Page, item (73) Assignee, add the name of the second assignee --MEA Technologies Pte. Ltd.--.

In the Claims:

In Claim 7, column 17, line 21, the word "pads" should be --parts--.

This certificate supersedes the Certificate of Correction issued February 23, 2010.

Signed and Sealed this

Thirty-first Day of August, 2010

David J. Kappos

David J. Kappos
*Director of the United States Patent and Trademark Office*